US005613455A

United States Patent [19]

Yamashita et al.

[11] Patent Number: 5,613,455

[45] Date of Patent: Mar. 25, 1997

[54] NEEDLE RECEIVING ASSEMBLY AND SEWING MACHINE HAVING SAME

[75] Inventors: Takashi Yamashita; Mitsuo Watanabe, both of Tokyo, Japan

[73] Assignee: Juki Corporation, Tokyo, Japan

[21] Appl. No.: 495,256

[22] Filed: Jun. 27, 1995

[30] Foreign Application Priority Data

Jun. 29, 1994 [JP] Japan ..... 6-148164

[51] Int. Cl.[6] ..... D05B 55/06; B65H 57/00

[52] U.S. Cl. ..... 112/302; 112/192; 112/227; 112/260

[58] Field of Search ..... 112/232, 185, 112/187, 189, 192, 302, 227, 260

[56] References Cited

U.S. PATENT DOCUMENTS

| | | | |
|---|---|---|---|
| 1,170,666 | 2/1916 | Parkes | 112/227 X |
| 1,388,943 | 8/1921 | Gatchell | 112/227 |
| 3,023,721 | 3/1962 | Johnson | 112/227 X |
| 3,044,427 | 7/1962 | Gardner et al. | 112/227 X |
| 3,125,049 | 3/1964 | Redman | 112/227 X |
| 3,533,368 | 10/1970 | Finster | 112/227 |
| 4,428,314 | 1/1984 | Renaud | 112/227 |
| 4,606,288 | 8/1986 | Jurgens | 112/227 |
| 5,425,320 | 6/1995 | JeanBlanc | 112/227 |

FOREIGN PATENT DOCUMENTS 99353 6/1995 Japan .

*Primary Examiner*—Paul C. Lewis
*Attorney, Agent, or Firm*—Morgan, Lewis and Bockius LLP

[57] ABSTRACT

A needle receiving assembly for a sewing machine comprising a throat plate through which a sewing needle can pass and a needle collar for regulating a rear loop of an upper thread passing through the sewing needle. The position of the needle collar relative to the sewing needle is adjustable.

17 Claims, 5 Drawing Sheets

NEEDLE RECEIVING ASSEMBLY AND SEWING MACHINE HAVING SAME

BACKGROUND OF THE INVENTION

1. Field of the Invention

This invention relates to a sewing machine, and more particularly, to a needle receiving assembly for a sewing machine.

2. Description of the Related Art

A full-turn shuttle hook and a half-turn shuttle hook are two examples of available shuttle bodies in sewing machines. In one type of the half-turn shuttle hook (hereinafter referred to as a "DBS shuttle hook"), the needle comes between an upper thread loop and the bobbin. The needle drop position is between the bobbin thread lead-out point of the bobbin and the beak of the shuttle body. In another type of the half-turn shuttle hook (hereinafter referred to as a "DPS shuttle hook"), the upper thread loop comes between the needle and the bobbin. Here, the beak of the shuttle body is between the needle drop position and the bobbin thread lead-out point of the bobbin.

A sewing machine incorporating a DBS shuttle hook forms perfect stitches in a forward feeding direction in which a fabric is fed in a right-to-left direction as viewed from the operator, and forms hitch stitches in a reverse feeding operation (in which a fabric is fed in a left-to-right direction as viewed from the operator). Hence, the sewing machine of this type is extensively employed for lock stitching.

In general, in lock stitching, perfect stitching should be employed to form straight stitches from the view point of the quality of stitches, and in order to eliminate the difficulty of a thread getting loose at both ends of a line of stitches, the latter should be ended by hitch stitching. In order to meet these requirements, a DBS shuttle hook is employed. However, a sewing machine having a DBS shuttle hook is not suitable for omnidirectional stitching.

A sewing machine incorporating a DPS shuttle hook is also known in the art (see, e.g., Japanese Patent No. 99353). This type of sewing machine is capable of forming perfect stitches in both the forward feeding direction and the reverse feeding direction and is thus suitable for omnidirectional stitching. However, this type of sewing machine is not popularly employed in the art yet. Additionally, it should be noted that the DPS shuttle hook responds well to the variation in thickness of a fabric, and is thus suitable for sewing a heavy weight fabric and for use with a thread large in yarn number count.

FIG. 6 shows a conventional bobbin case 100 used with a half-turn shuttle. As shown in FIG. 6, the bobbin case 100 has an engaging member 101, in which a thread hole 102 is formed. A bobbin thread 104 supplied from a bobbin 103 accommodated in the bobbin case 100 is passed through the thread hole 102 of the horn 101 of the bobbin case 100. The bobbin case is set in the sewing machine (not shown) such that it faces forward so that it is conveniently handled by an operator when it is set in or removed from the sewing machine.

The direction of rotation of the shuttle body should be determined so that the upper thread on the needle side is twistable because a sewing thread for a sewing machine is fundamentally of Z-twist. Thus, in the case of a DBS shuttle hook, the direction of rotation of the shuttle body is clockwise as viewed from the operator side. However, in the case of a DPS shuttle hook, the direction of rotation of the shuttle body is counterclockwise.

FIG. 7 shows a conventional shuttle race body 121 and a conventional shuttle race ring 125. The shuttle race body 121 has a recess 122 which is opened upwardly and in its joining surface which is brought into contact with the shuttle race ring 125. The shuttle race ring 125 has a needle receiving section (or rear loop receiving section) 126 in its joining surface which is brought into contact with the joining surface of the shuttle race body 121 in such a manner that the needle receiving section 126 confronts with the recess 122 of the shuttle race body 121. In FIG. 7, reference numeral 127 designates an engaging groove with which the horn 101 (FIG. 6) is engaged.

FIG. 8 shows the needle receiving section (or rear loop receiving section) 126 with the shuttle race ring 125 coupled to the shuttle race body 121. As shown in FIG. 9, when a DBS shuttle hook is employed, the needle receiving section 126 of the shuttle race ring 125 is capable of regulating a rear limb 114*r* on one side of the needle 113 and securing a front limb 114R on the other side. The front limb 114R is scooped up with the beak 112 of the DBS shuttle hook.

A sewing machine incorporating a DBS shuttle hook and a sewing machine incorporating a DPS shuttle hook will now be compared with reference to FIGS. 10(*a*) and 10(*b*).

In FIG. 10(*a*), reference numeral 111 designates the DBS shuttle hook; 112, the beak of the DPS shuttle hook 111; 113, the needle; 114, the upper thread; and R, the upper thread loop. In FIG. 10(*b*), reference numeral 115 designates the DPS shuttle hook; and 116, the beak of the DPS shuttle hook 115.

In the case where the DBS shuttle hook 111 is employed, the distance (1) between the needle drop point and the bobbin thread lead-out point is as shown in FIG. 10(*a*). In the case where the DPS shuttle hook 115 is employed, the distance (2) between the needle drop point and the bobbin thread lead-out point is as shown in FIG. 10(*b*). As shown in FIGS. 10(*a*) and 10(*b*), the distance (2) is larger than the distance (1).

In the case where the DPS shuttle hook 115 is employed, the distance (2) between the needle drop point and the bobbin thread lead-out point must be shifted laterally as much as (the width of the lace of the shuttle body+$\alpha$ (alpha)) when compared with the distance (1) between the needle drop point and the bobbin thread lead-out point in the case where the DBS shuttle hook 11 is employed.

In the case where the DPS shuttle hook 115 is employed, the beak 116 comes between the needle receiving groove (or rear loop receiving section) 126 of the shuttle race ring 125, and the loop R of the upper thread 114 is positioned on the side of the needle receiving section 126. Hence, in this case, unlike the case where the DBS shuttle hook is employed, the needle receiving groove 126 cannot regulate the rear limb.

However, if, in the case where the DPS shuttle hook 115 is employed, the rear limb cannot be regulated as was described above, then it is impossible to obtain the front limb sufficiently, and accordingly it may be impossible to scoop it up with the beak.

Heretofore, the shuttle race ring 125 has been integral with the needle receiving section (or rear loop receiving section) 126. Hence, it was impossible to adjust the position of the needle receiving section 126. This is another problem accompanying the employment of the DPS shuttle hook 115.

SUMMARY OF THE INVENTION

The present invention has been made in view of the above circumstances and has as an object to provide a needle receiving assembly for a sewing machine using the DPS shuttle hook which is capable of positively regulating the rear limb and which can be adjusted in position.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a needle receiving assembly for a sewing machine is provided, comprising a throat plate through which a sewing needle can pass and a needle collar for regulating a rear loop of an upper thread passing through the sewing needle, the needle collar being adjustable in position relative to the sewing needle.

To further achieve the objects and in accordance with the purpose of the invention, as embodied and broadly described herein, a sewing machine is also provided, comprising means for driving a sewing needle, and a needle assembly, the needle assembly including a throat plate through which the sewing needle passes when driven by the driving means and a needle collar for regulating a rear loop of an upper thread passing through the sewing needle, the needle collar being adjustable in position relative to the sewing needle.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the written the drawings:

FIG. 10(*b*) is a cut-away side view of a DPS shuttle hook showing the distance between the needle drop point and the bobbin thread lead-out point.

DETAILED DESCRIPTION OF THE PREFERRED EMBODIMENTS

The needle collar of the present invention is adjustable in position. Hence, even in a sewing machine using the DPS shuttle hook, the rear loop of the upper thread can be positively regulated. In addition, by changing the position of the needle collar, the amount of regulation of the rear loop of the upper thread can be suitably adjusted.

The needle collar is mounted on the thread control panel having the thread control hole in such a manner that it is adjustable in position. Hence, in the sewing machine using the DPS shuttle hook, the needle collar adapted to regulate the rear loop of the upper thread can be arranged by use of the thread control panel, and the needle collar can be readily adjusted in position.

A needle receiving assembly for a sewing machine according to the invention will now be described with reference to FIGS. 1 through 5.

Figure 1:
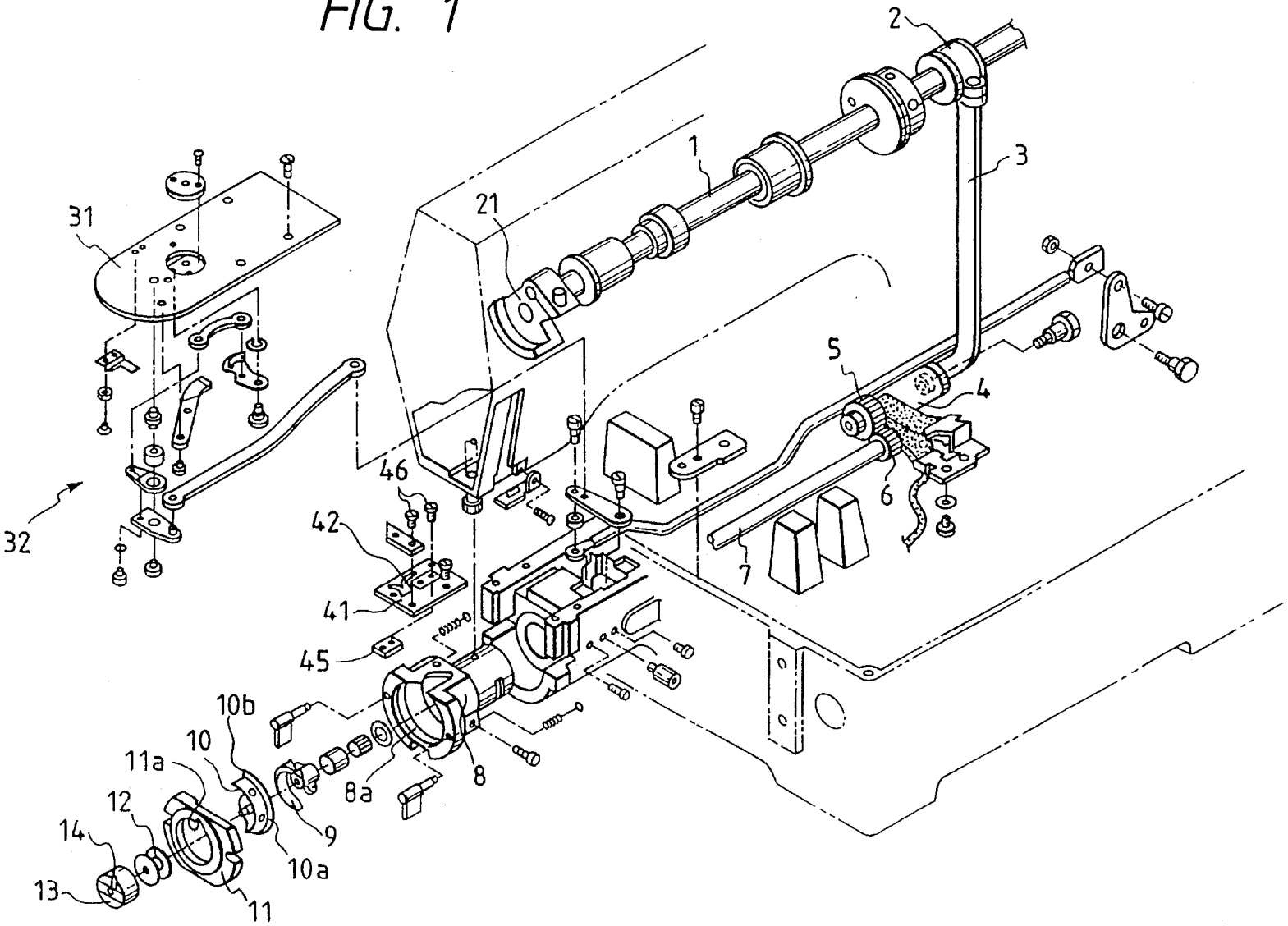
FIG. 1 is an exploded perspective view of a shuttle driving device in a sewing machine according to one embodiment of the invention.

As shown in FIG. 1, a shuttle driving device according to the invention comprises a spindle (or arm shaft) 1, a crank section 2, a crank rod 3, an oscillating rock shaft 4, gears 5 and 6, a lower shaft 7, a shuttle race body 8, a driver 9, a shuttle body (or DPS shuttle hook) 10, a shuttle race ring 11, a bobbin 12, a bobbin case 13, a horn of the bobbin case 14, a arm shaft counter balance 21, a throat plate 31, a thread cutting device 32, a thread control panel (or shuttle race cap) 41, a thread control hole 42, and a needle collar (or rear loop receiving member) 45.

The arm shaft 1 has a pulley (not shown) at the right end to which the torque of the electric motor is applied through an endless belt. The arm shaft 1 is couple to the crank rod 3 via the crank section 2. The lower end portion of the crank rod 3 is eccentrically coupled to the oscillating rock shaft 4. The gears 5 and 6 are mounted on the oscillating rock shaft 4 and the lower shaft 7, respectively, such that they are engaged with each other. Near the left end of the lower shaft 7, the shuttle race body 8 is fixed to the sewing machine body.

The driver 9 is coupled to the left end of the lower shaft 7, and rotatably provided inside the shuttle race body 8. In addition, the shuttle body driven by the driver 9, namely, the DPS shuttle hook 10, is also rotatably provided inside the shuttle race body 8. More specifically, a race 10*a* formed along the outer periphery of the DPS shuttle hook 10 is slidably fitted in a race 8*a* which is also formed along the outer periphery of the shuttle race body 8. The prolongation of the race 10*a* is formed into a beak 10*b* (See FIG. 5). The DPS shuttle hook 10 is turned counter-clockwise by the driver 9.

The shuttle race ring 11 is fixed to the shuttle race body 8. The bobbin case 13 accommodating the bobbin 12 is set in the shuttle race body 8 through the opening of the shuttle race ring 11.

The engaging member 14 protrudes outwardly from the bobbin case 13. The shuttle race ring 11 has an engaging groove 11*a* with which the horn 14 is engaged.

Figure 2:
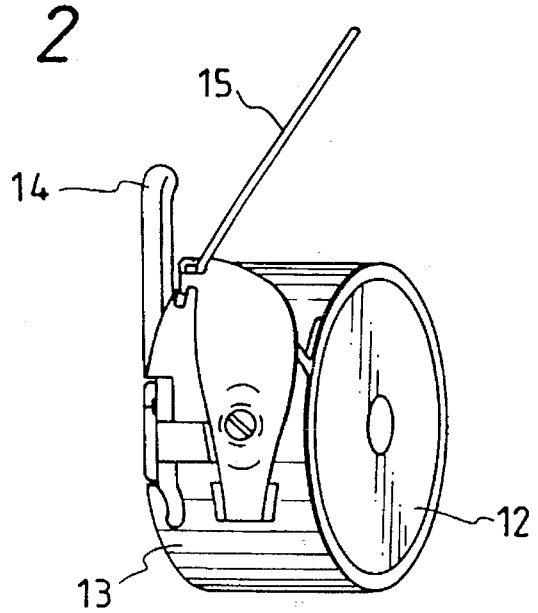
FIG. 2 is a perspective view of a bobbin case.
Figure 6:
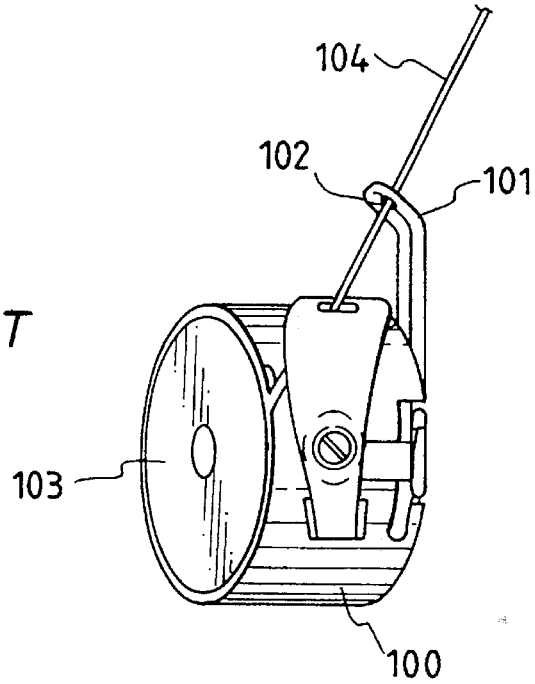
FIG. 6 PRIOR ART
FIG. 6 is a perspective view of a conventional bobbin case provided for a half-turn shuttle.
Figure 7:
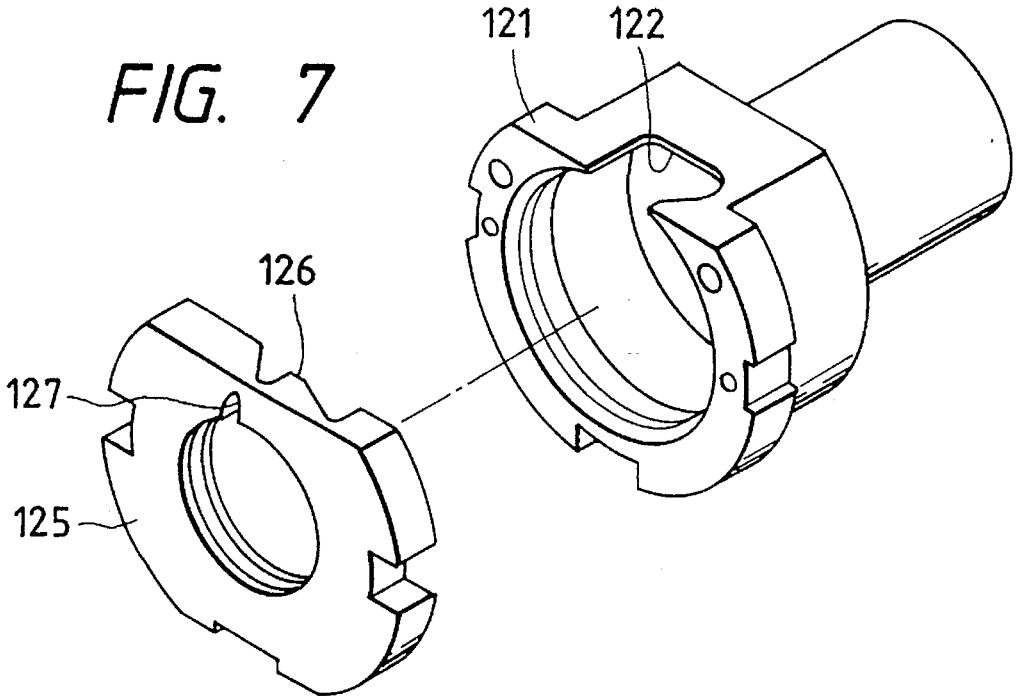
FIG. 7 is an exploded perspective view of a conventional shuttle race body and a conventional shuttle race ring in a sewing machine.
Figure 8:
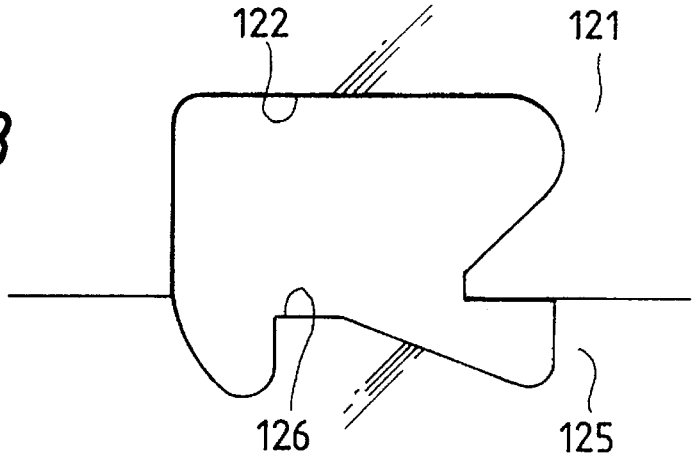
FIG. 8 is an enlarged plan view of a needle receiving section with the shuttle body coupled to the shuttle race body.
Figure 9:
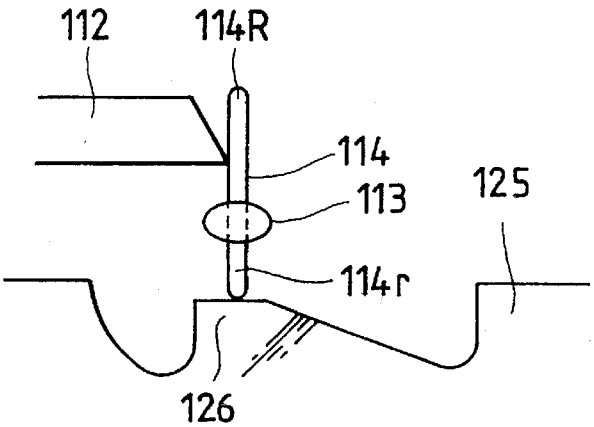
FIG. 9 is a plan view showing how the rear limb is regulated by the needle receiving section of the shuttle race ring in the sewing machine using the DPS shuttle hook.
Figure 10A:
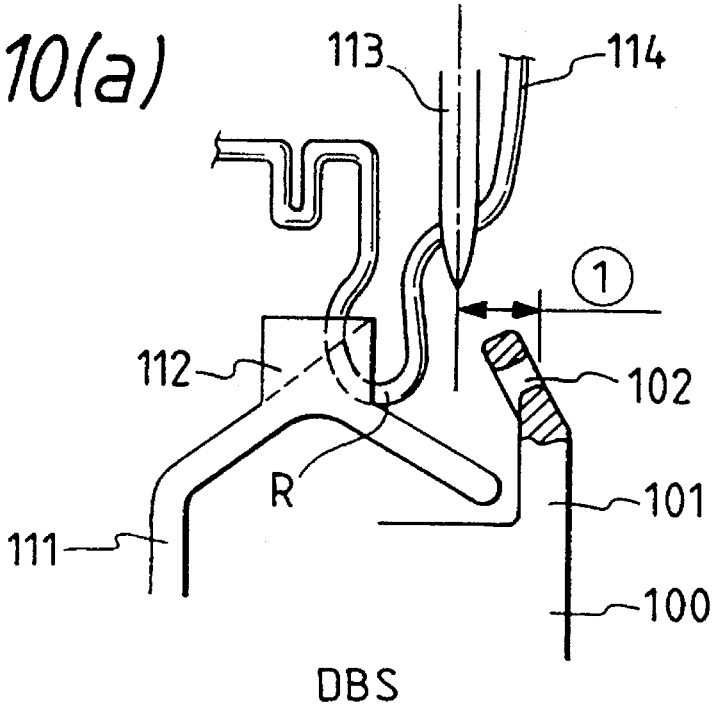
FIG. 10(*a*) is a cut-away side view of a DBS shuttle hook showing the distance between the needle drop point and the bobbin thread lead-out point.
Figure 10B:
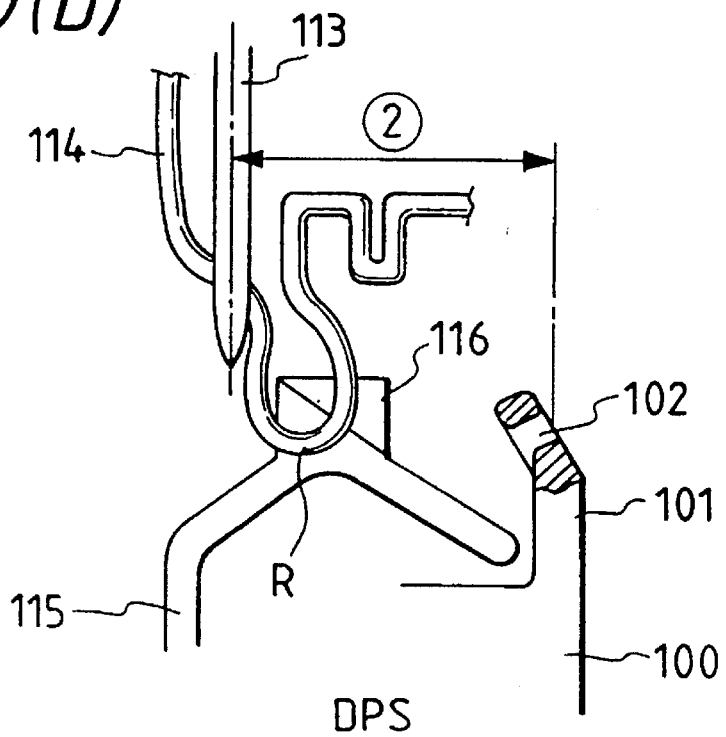

As shown in FIG. 2, the amount by which the horn 14 of the present invention protrudes from bobbin case 13 is less than that of the conventional horn 101 of FIG. 6. Also, unlike the conventional horn 101, horn 14 of the present invention has no thread hole. Hence, the bobbin thread 15 wound on the bobbin 12 is merely led out of the bobbin case 13 irrespective of the horn 14.

The length of the horn 14 is determined from the position of the driver 9 (FIG. 1). That is, the horn 14 of the bobbin case 13 is designed such that the upper end of the horn 14 comes below the upper surface of the driver 9 when the angle of rotation of the arm shaft 1 is in a range of 5° to 35° with the top dead point of the needle bar as a reference (0°).

The counter balance 21 is coupled to the left end of the arm shaft 1. In front of the counter balance 21, a thread take-up lever, needle bar crank, needle bar crank rod, needle bar, and needle are provided.

The throat plate 31 is provided above the shuttle race body 8. The thread cutting device 32 and the thread control panel (or shuttle race cap) 41 are provided between the throat plate 31 and the shuttle race body 8 in such a manner that the thread control panel 41 is located below the thread cutting device 32.

The sewing machine thus designed operates as follows. First, the torque of the motor is applied through the endless belt to the pulley, so that the arm shaft 1 is rotated to drive the needle, while the full turn motion of the arm shaft 1 is converted into a swing motion with the aid of the crank section 2 and the crank rod 3, so that the oscillating rock shaft 4 swings.

The swinging motion of the oscillating rock shaft 4 is transmitted through the gears 5 and 6 to the lower shaft 7. That is, it is converted into the half turn motion of the lower shaft 7. Hence, the DPS shuttle hook 10, being driven by the driver 9 integral with the lower shaft 7, performs a half turn motion in the counterclockwise direction.

Figure 3:
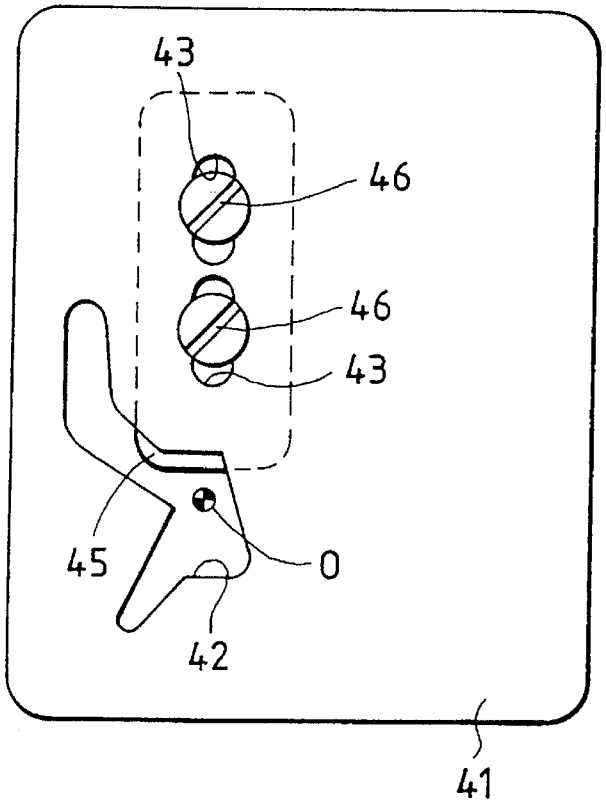
FIG. 3 is a plan view of a shuttle race cap according to the invention.
Figure 4:
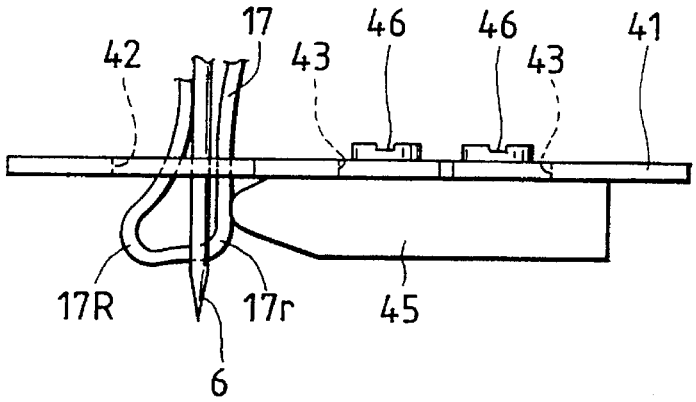
FIG. 4 is a side view of the shuttle race cap of FIG. 3.
Figure 5:
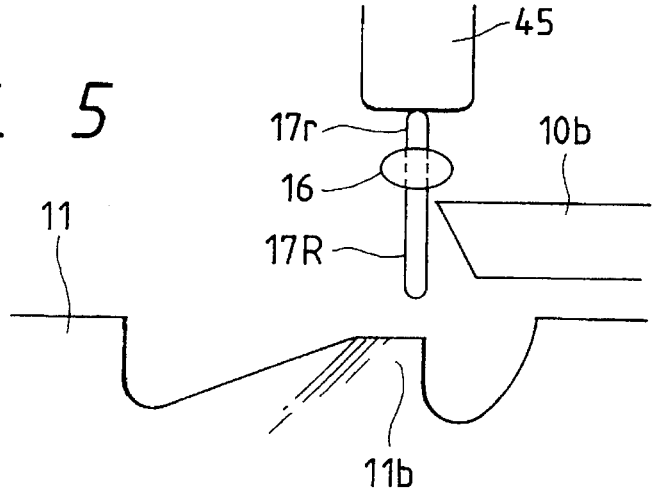
FIG. 5 is a plan view of the shuttle race cap showing how to scoop up a front limb with a beak of a DPS shuttle hook in a sewing machine with the needle receiving assembly according to the invention.

In the sewing machine with the above-described DPS shuttle hook 10, as shown in FIGS. 3 and 4, the needle collar (or rear loop receiving member) 45 adapted to regulate the rear loop **17*r* of the upper thread 17 passed through the needle hole of the needle 16 is mounted on the shuttle race cap 41 which is the thread control panel having the thread control hole 42, such that the position of the needle collar 45 is adjustable. That is, in the case where the DPS shuttle hook 10 is employed, as shown in FIG. 5, the beak 10*b* comes between the shuttle race ring 11 and the sewing needle 16, and the front loop 17R of the upper thread 17 is on the side of the shuttle race ring 11. Hence, in this case, unlike the case where the DBS shuttle hook is employed, the rear loop 17*r* on the opposite side cannot be regulated with the needle receiving section (or rear loop receiving section) 11*b* of the shuttle race ring 11**.

Hence, in the embodiment of the invention, as shown in FIGS. 3 and 4, the needle collar (or rear loop receiving member) 45 is arranged on the lower surface of the shuttle race cap 41 such that it appears partially in the thread control hole 42. Further, two fixing screws 46 are screwed into the needle collar (or rear loop receiving member) 45 through adjusting elongated holes 43 formed therein, so that the position of the needle collar (or rear loop receiving member) 45 is adjustable.

The thread control hole 42 receives the upper thread 17 and the bobbin thread 15, and, especially when a thread cutting operation is carried out by the thread cutting device 32, slings the upper thread 17 towards the needle and the fabric and slings the bobbin thread 15. The thread control hole 42 is suitably shaped as shown in FIG. 3, wherein reference character O designates the needle drop point.

As was described above, the needle collar (or rear loop receiving member) 45 is mounted on the lower surface of the shuttle race cap 41 such that its position can be adjusted with the fixing screws 46 set in the adjusting elongated holes 43. Hence, in the sewing machine employing the DPS shuttle hook 10, as shown in FIG. 4, the rear loop **17*r* of the upper thread below the thread control hole 42 is regulated with the needle collar (or rear loop receiving member) 45, and the front loop 17R can be sufficiently obtained on the side of the shuttle race ring 11**.

The position of the needle collar (or rear loop receiving member) 45 can be adjusted by shifting the fixing screws 46 along the adjusting elongated holes 43, which makes it possible to suitably adjust the amount of regulation of the rear limb **17*r***.

As was described above, the DPS shuttle hook 10 performs the half turn motion in the counterclockwise direction. Hence, the front limb 17R can be positively scooped up with the beak **10*b* which is moved to the left in FIG. 5**. Thus, high quality stitches can be formed with the sewing machine using the DPS shuttle hook.

In the above-described embodiment, the bobbin case for the DPS shuttle hook has a short horn having no thread hole. However, the invention is not limited this embodiment. That is, it may be a conventional bobbin with a long horn having a thread hole.

In the above-described embodiment, the needle collar is mounted on the shuttle race cap. However, the needle collar can alternatively be mounted on the sewing machine body.

Furthermore, the configuration of the needle collar is not always limited to that which has been described above. In addition, the needle collar may be suitably changed or modified in structure without departing from the spirit of the invention.

As is apparent from the above description, the needle receiving assembly according to the invention has the following benefits. The needle collar, which is adjustable in position, regulates the rear loop of the upper thread passed through the needle. Hence, especially in a sewing machine using a DPS shuttle hook, the rear limb can be positively regulated, and the front limb can be positively scooped up with the beak.

In addition, since the position of the needle collar can be adjusted, the amount of regulation of the rear limb can be suitably adjusted.

Furthermore, the needle collar (or rear loop receiving member) can be mounted on the thread control panel having the thread control hole such that its position is adjustable. Hence, in the sewing machine using a DPS shuttle hook, the needle collar adapted to regulate the rear loop of the upper thread can be arranged by use of the thread control panel, and the position of the needle collar can be readily adjusted.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A needle receiving assembly for a sewing machine, comprising:

a throat plate through which a sewing needle can pass;

a needle collar for regulating a rear loop of an upper thread passing through the sewing needle, the needle collar being adjustable in position relative to the sewing needle; and a throat control panel disposed between the throat plate and the needle collar, the thread control panel having a thread control hole for receiving the sewing needle and the needle collar being adjustably mounted to the thread control panel.

2. The needle receiving assembly of claim 1, further comprising means for adjustably mounting the needle collar to the thread control panel.

3. The needle receiving assembly of claim 2, wherein the means for adjustably mounting the needle collar to the thread control panel includes at least one fixing screw passing through at least one elongated hole formed through the thread control panel.

4. The needle receiving assembly of claim 1, wherein the needle collar is adjustably mounted to a body of the sewing machine.

5. A needle receiving assembly for a sewing machine, comprising:

a throat plate through which a sewing needle passes;

means for regulating a rear loop of an upper thread passing through the sewing needle, the regulating means being adjustable in position relative to the sewing needle; and a thread control panel disposed between the throat plate and the regulating means, the thread control panel having a thread control hole for receiving the sewing needle and the regulating means being adjustably mounted to the thread control panel.

6. The needle receiving assembly of claim 5, further comprising means for adjustably mounting the regulating means to the thread control panel.

7. The needle receiving assembly of claim 6, wherein the means for adjustably mounting the regulating means to the thread control panel includes at least one fixing screw passing through at least one elongated hole formed through the thread control panel.

8. The needle receiving assembly of claim 5, wherein the regulating means is adjustably mounted to a body of the sewing machine.

9. A sewing machine, comprising:

means for driving a sewing needle; and a needle receiving assembly, the needle receiving assembly including a throat plate through which the sewing needle passes when driven by the driving means, a needle collar for regulating a rear loop of an upper thread passing through the sewing needle, the needle collar being adjustable in position relative to the sewing needle, and a thread control panel disposed between the throat plate and the needle collar, the thread control panel having a thread control hole for receiving the sewing needle and the needle collar being adjustably mounted to the thread control panel.

10. The sewing machine of claim 9, wherein the needle receiving assembly further includes means for adjustably mounting the needle collar to the thread control panel.

11. The sewing machine of claim 10, wherein the means for adjustably mounting the needle collar to the thread control panel includes at least one fixing screw passing through at least one elongated hole formed through the thread control panel.

12. The sewing machine of claim 9, wherein the needle collar is adjustably mounted to a body of the sewing machine.

13. A sewing machine, comprising:

means for driving a sewing needle; and a needle receiving assembly, the needle receiving assembly including a throat plate through which the sewing needle passes when driven by the driving means, means for regulating a rear loop of an upper thread passing through the sewing needle, the regulating means being adjustable in position relative to the sewing needle, and a thread control panel disposed between the throat plate and the regulating means, the thread control panel having a thread control hole for receiving the sewing needle and the regulating means being adjustably mounted to the thread control panel.

14. The sewing machine of claim 13, wherein the needle receiving assembly further includes means for adjustably mounting the regulating means to the thread control panel.

15. The sewing machine of claim 14, wherein the means for adjustably mounting the regulating means to the thread control panel includes at least one fixing screw passing through at least one elongated hole formed through the thread control panel.

16. The sewing machine of claim 13, wherein the regulating means is adjustably mounted to a body of the sewing machine.

17. A needle receiving assembly for a sewing machine, comprising:

a throat plate through which a sewing needle can pass;

a needle collar for regulating a rear loop of an upper thread passing through the sewing needle; and a thread control plate disposed between the throat plate and the needle collar, the thread control plate having a thread control hole for receiving the sewing needle, and the needle collar being disposed beneath the thread control hole.

* * * * *